United States Patent [19]

La Rose

[11] Patent Number: 4,466,674

[45] Date of Patent: Aug. 21, 1984

[54] HOME VIDEO GAME STORAGE UNIT

[76] Inventor: Thom La Rose, 2107 Logan Dr., Sterling Hgts., Mich. 48077

[21] Appl. No.: 416,962

[22] Filed: Sep. 13, 1982

[51] Int. Cl.[3] ..... A47B 91/06

[52] U.S. Cl. ..... 312/250; 312/324; 312/237

[58] Field of Search ..... 312/237, 250, 294, 320, 312/324, 330 R, DIG. 33; 108/92, 93

[56] References Cited

U.S. PATENT DOCUMENTS

| | | | |
|---|---|---|---|
| 2,285,159 | 6/1942 | Hanson et al. | 312/325 X |
| 2,578,049 | 12/1951 | Dapprich | 312/320 |
| 3,180,697 | 4/1965 | Mulch | 312/320 X |
| 4,173,024 | 10/1979 | Miller | 358/115 |
| 4,274,685 | 6/1981 | Bradshaw | 312/7 |
| 4,369,763 | 1/1983 | Sullivan | 312/250 X |

FOREIGN PATENT DOCUMENTS

| | | | |
|---|---|---|---|
| 2402554 | 7/1975 | Fed. Rep. of Germany | 312/351 R |

*Primary Examiner*—William E. Lyddane
*Assistant Examiner*—Joseph Falk
*Attorney, Agent, or Firm*—Gifford, VanOphem, Sheridan, Sprinkle & Nabozny

[57] ABSTRACT

A unique storage unit for a home video game is disclosed. The storage unit comprises a base having a front wall, a rear wall and spaced side walls which together define an interior of the base having an open top. At least one interior wall extends through the interior of the base thus dividing the base into at least two compartments, each of which is dimensioned to hold a predefined component of a home video game. A cover is movable between a closed position in which the cover closes the open top of the base and an open position in which the components of the video game are accessible through the top of the base. With the cover in its closed position, the storage unit can conveniently be used as a cocktail table.

7 Claims, 8 Drawing Figures

HOME VIDEO GAME STORAGE UNIT

BACKGROUND OF THE INVENTION

I. Field of the Invention

The present invention relates generally to storage units and, more particularly, to a storage unit for a home video game.

II. Description of the Prior Art

Home video games are rapidly becoming a popular accessory for many televisions in the home. The home video game typically comprises a main unit into which a game cassette is inserted. Each different game cassette normally produces a different video game on the television screen. In addition to the main unit and the cassettes, the home video game usually includes at least one and usually two game paddles or joy sticks which are separate from but electrically connected to the main unit. The joy sticks are used by the players during the video game to control the play of the game on the television screen.

There are no previously known storage units which are particularly designed to store the various components of a home video game. Consequently, the various components of the video game are oftentimes simply piled on top of the television set or shelf near the television set. This not only provides an unsightly appearance for the home video game when not in use but also exposes the components of the video game to damage from dust, accidental mishaps and the like. Furthermore, the game paddles and main unit must be removed from the television set, or shelf and placed in front of the set each different time the game is played.

SUMMARY OF THE PRESENT INVENTION

The present invention provides a storage unit for a home video game which overcomes the above-mentioned disadvantages.

In brief, the storage unit of the present invention comprises a base having a front wall, a rear wall and spaced side walls which, together, define an interior of the base. The base is open at its top and rests on its bottom on a support surface, such as the floor.

At least one interior wall extends through the interior of the base and divides the base interior into at least two and preferably more distinct compartments. Each of these compartments is dimensioned to hold a predefined component of the home video game, such as the game paddle or game cassettes.

A cover is movable between an open and closed position with respect to the base. In its closed position, the cover closes the open top of the base and not only hides the various components of the video game from sight but also protects these components from damage. With the cover in its closed position, the storage unit can also be used as a cocktail table. Conversely, in its open position, the cover exposes the open top of the base and permits the removal and use of the video game components. Preferably casters are secured to the cover which engage the support surface and enable the cover to roll along the support surface between its open and closed positions.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
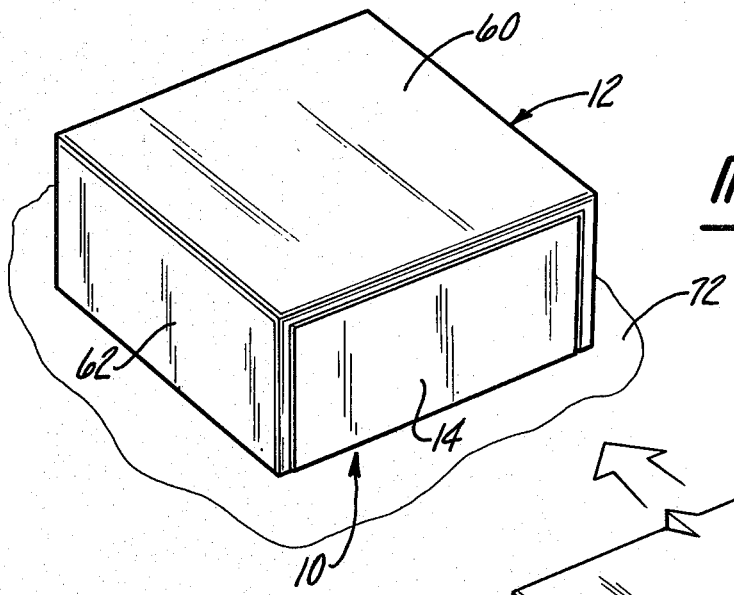
FIG. 1 is an elevational view illustrating a preferred embodiment of the storage unit of the present invention with the cover in its closed position.
Figure 2:
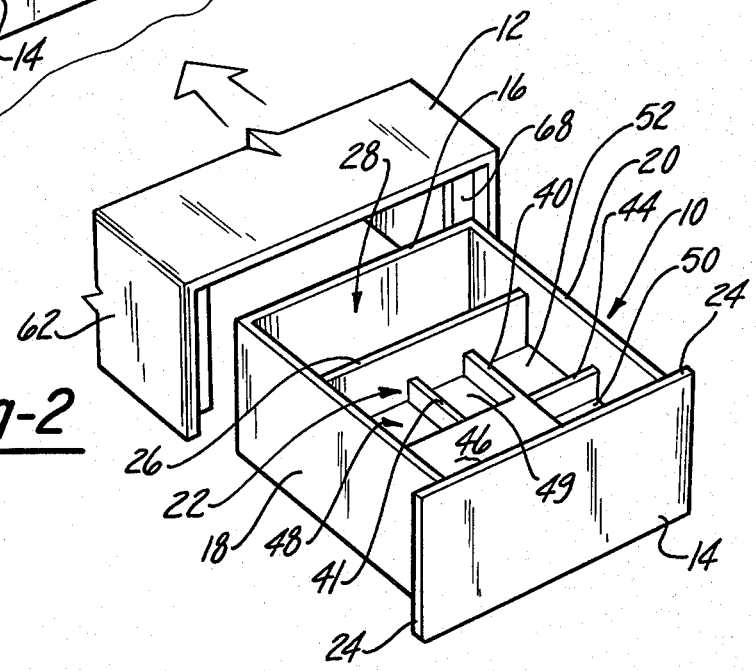
FIG. 2 is a fragmentary view similar to FIG. 1 but showing the cover in its open position.
Figure 3:
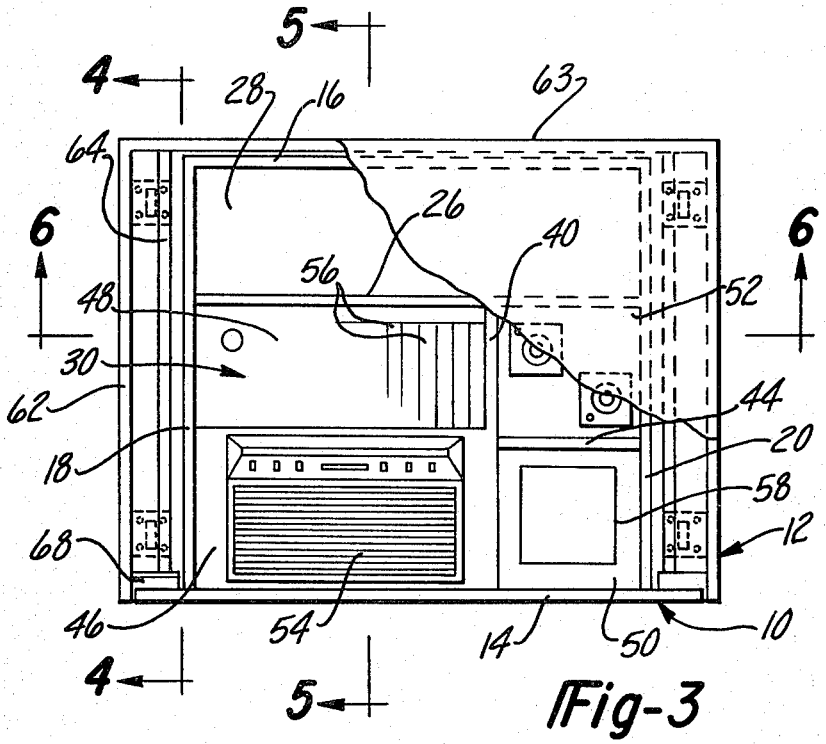
FIG. 3 is a fragmentary top plan view of a portion of the preferred embodiment of the present invention.

With reference first to FIGS. 1–3, a preferred embodiment of the home video game storage unit according to the present invention is there shown and comprises a base 10 and a cover 12. The base 10 comprises a front wall 14, rear wall 16 and spaced side walls 18 and 20. The front wall 14, rear wall 16 and side walls 18 and 20, together, define a generally rectangular interior 22 of the base 10. In addition, the front wall 14 is wider than the rear wall 16 so that each end of the front wall forms an abutment panel 24 which extends outwardly from the side walls 18 and 20. The purpose of the panels will be subsequently described.

The front wall 14, rear wall 16 and side walls 18 and 20 are planar and rectangular in shape. The walls 14–20 are secured together in any conventional fashion, such as by gluing, and the exposed surfaces of the base 10 and cover 12 can be finished in plastic laminate, corian, wood veneer or unfinished as desired.

Figure 5:
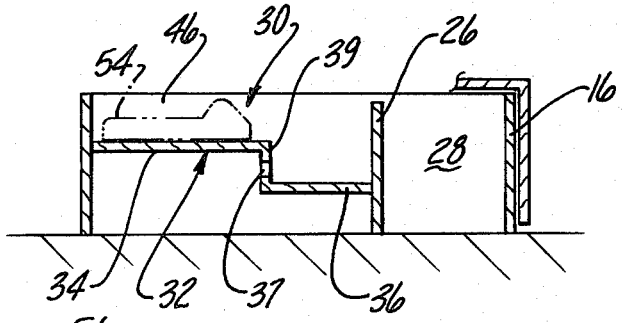
FIG. 5 is a sectional view taken along line 5—5 in FIG. 3.
Figure 6:
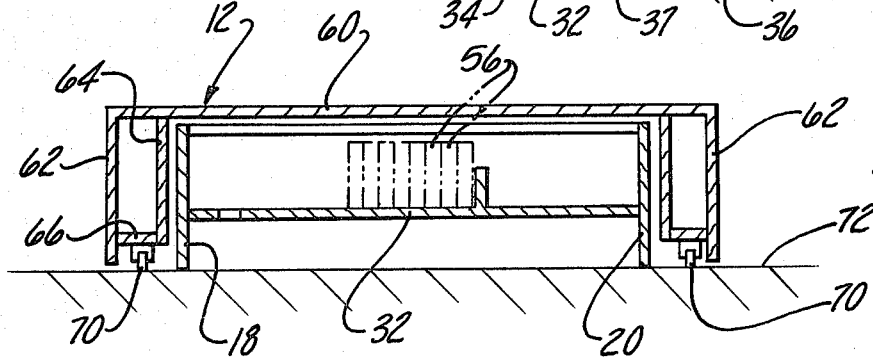
FIG. 6 is a sectional view taken along line 6—6 in FIG. 3.

Referring now particularly to FIGS. 3, 5 and 6, an interior wall 26 extends between and is secured to the side walls 18 and 20 at a position spaced forwardly from the rear wall 16. The interior wall 26 thus divides the interior 22 of the base 10 into a rear compartment 28 and a forward compartment 30. A generally horizontally extending floor 32 (FIGS. 5 and 6) having a raised portion 34 and a lower portion 36 is positioned within the front compartment 30 and secured between the side walls 18 and 20, front wall 14 and interior wall 26. A wire management hole 37 (FIG. 5) is formed through a vertically extending portion 39 of the floor 32 between the raised and lower portions 34 and 36. A pair of small longitudinal interior walls 40 and 41 (FIG. 3) extend rearwardly from one end of the floor raised portion 34 and the interior wall 26. Similarly, a small interior wall 44 (FIG. 3) extends from one side wall 20 and laterally to the floor raised portion 34 so that the small interior walls 40 and 44 intersect each other substantially perpendicularly while, as shown in FIG. 2, the walls 40 and 41 are spaced and parallel. The wall 44 may be adjustable.

As best shown in FIGS. 2 and 3, the interior walls 26, 40 and 44 together with the floor 32 divides the front compartment 30 of the base interior 22 into five distinct subcompartments 46, 48, 49, 50 and 52. The front subcompartment 46 is particularly dimensioned to receive and support a main unit 54 of a home video game. Similarly, the subcompartments 48 and 49 are particularly designed to hold a number of game cartridges 56 for the home video game while the remaining compartments 50 and 52 are dimensioned to receive and support game paddles 58 for the home video game. Preferably, the vertical height of both the raised portion 34 and lower portion 36 of the floor 32 are dimensioned so that with the main unit 54, game cartridges 56 and game paddles 58 of the home video game positioned within their respective compartments, each component of the video game is recessed beneath the open top of the base 10.

Figure 4:
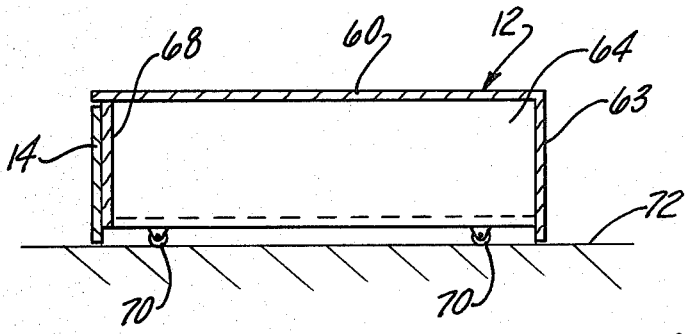
FIG. 4 is a sectional view taken along line 4—4 in FIG. 3.

With reference now particularly to FIGS. 4 and 6, the cover 12 comprises a generally rectangular top 60 having a pair of side walls 62 extending downwardly from opposite sides of the top 60 and a rear wall 63 extending downwardly from the rear edge of the top 60. A support panel 64 is secured to the cover top 60 at a position spaced inwardly from but generally parallel to the cover side walls 62. A lower base panel 66 extends generally horizontally between the lower end of each support panel 64 and the side panels 62. The support panels 64 together with the base panels 66 rigidify the construction of the cover 12 and prevents the side panels 62 from bowing outwardly with respect to the top 60. A facia panel 68 (FIGS. 3 and 4) covers the space between the cover side walls 62 and the support panels 64 at a position recessed from the front of the cover 12.

Still referring to FIGS. 4 and 6, one or more non-swivel casters 70 are secured to each base panel 66. The casters 70 contact a lower support surface 72 on which the base 10 rests. The casters 70 enable the cover side to be easily rolled on the support surface 72.

With reference now particularly to FIGS. 1–3, with the various components of the home video game positioned within their respective subcompartments 46, 48, 49, 50 and 52 in the base, the base 10 is positioned on the lower support surface 72. Connecting wires between the home video game and the television as well as power outlets are contained within the rear compartment 28 for organized wire management. This rear compartment 28 is also preferably open at its bottom so that the wires connecting the home video game to the television extend down through the bottom of the rear compartment for a more sightly appearance.

With reference to FIGS. 1 and 2, the base 10 is generally stationary with respect to the lower support surface 72. Conversely, the cover 12 is movable between an open position, as shown in FIG. 2, and a closed position as shown in FIG. 1. In its opening position, the open top of the base 10 is exposed so that the various components of the home video game can be removed from the base 10 as required for use.

Conversely, in its closed position, the top 60 covers the open top of the base 10 and thus protects the home video game components from dust and accidental mishaps. Furthermore, with the cover 12 closed, the storage unit hides the otherwise unsightly appearance of the home video game and the unit can also be used as a cocktail table. With the base in its closed position, the abutment panels 24 on the base but against the facia panels 68 on the cover 12. Consequently, the facia panels 68 form stop members which limit the inward movement of the base 10 into the cover 12. Since the facia panels 68 are recessed from the front lip of the cover 12, the front 14 of the base 10 is flush with the top 60 and side walls 62 of the cover 12.

Figure 7:
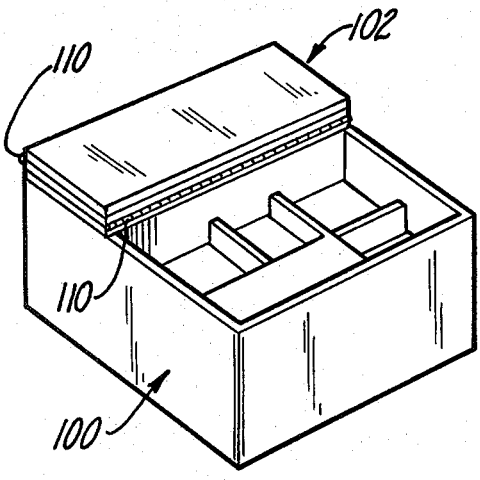
FIGS. 7 and 8 are perspective views illustrating a second preferred embodiment of the invention.
Figure 8:
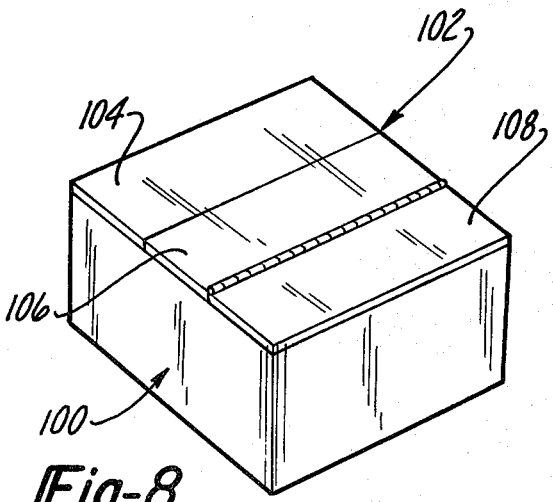

With reference now to FIGS. 7 and 8, a second preferred embodiment of the invention is thereshown comprising a base 100 and a cover 102. The base 100 is substantially the same as the base 10 except that the abutment panels 24 on the front 14 of the base are eliminated. Therefore, a further description of the base 100 is unnecessary.

Unlike the cover 12, however, the cover 102 comprises three panels 104, 106 and 108 which are secured together by hinges 110. The cover 102 is movable between an open position, shown in FIG. 7, and a closed position, shown in FIG. 8. With the cover 102 in its open position, the hinged panels 104, 106 and 108 are stacked one upon the other thus exposing the components of the video game while covering the rear compartment 28 of the base 100. Consversely, with the cover 102 in its closed position, the cover 102 covers the open top of the base 100.

From the foregoing, it can be seen that the present invention provides a convenient storage unit for a home video assembly which not only hides the home video components from sight when not in use but also protects the home video game components from dust and other accidental mishaps. The entire unit can be finished as desired for example in plastic laminate, corian, wood veneer or the like as desired by the ultimate user.

Also it should be apparent that although the invention has been described as being useful for home video game components, the storage unit with some modifications could be used to store other components, such as video recorders, as well.

Having described my invention, however, many modifications thereto will become apparent to those skilled in the art to which it pertains without deviation from the spirit of the invention as defined by the scope of the appended claims.

I claim:

1. A storage unit for a video component comprising:

a base having a front wall, rear wall and spaced side walls which together define an interior of said base, said base being open at its top and having a bottom stationarily supported on a ground surface, at least one interior wall extending through the interior of said base and dividing said base into at least two compartments, each of said compartments dimensioned to hold a predefined video component, a cover movable between a closed position in which said cover closes the open top of said base and an open position in which said compartments are accessible through the top of said base, said cover comprising a pair of side walls extending along but spaced outwardly from the side walls of said base, and at least one wheel secured to each cover side wall adjacent a bottom of each side wall, said wheels engaging the support surface.

2. The invention as defined in claim 1 wherein said at least one interior wall comprises a rear interior wall extending between said side walls at a position spaced from said base rear wall and thus forming a rear compartment and a front compartment, said rear compartment being open on its bottom.

3. The invention as defined in claim 1 wherein said front wall of said base comprises an outwardly extending portion at each end and wherein said cover comprises a stop member on each side of one end of said cover side walls, said stop member being recessed from an end of said cover so that, when said cover is in said closed position, said outwardly extending portions of said front wall abut against said stop members whereby said base front wall is wholly positioned beneath said cover.

4. The invention as defined in claim 2 and comprising a generally horizontally extending floor secured to said base within said front compartment.

5. The invention as defined in claim 4 wherein said floor comprises a raised portion and a lower portion.

6. The invention as defined in claim 1 wherein said cover further comprises a pair of support panels, one support panel secured to said cover top and side wall at a position parallel to but spaced inwardly from each cover side wall.

7. The invention as defined in claim 1 wherein said cover comprises at least three panels.

* * * * *